US005458810A

United States Patent [19]

Fredj et al.

[11] Patent Number: 5,458,810

[45] Date of Patent: Oct. 17, 1995

[54] ENZYMATIC DETERGENT COMPOSITIONS INHIBITING DYE TRANSFER

[75] Inventors: Abdennaceur Fredj, Brussels, Belgium; James P. Johnston, Overijse, United Kingdom; Christiaan A. J. Thoen, Haasdonk; Regine Labeque, Brussels, both of Belgium

[73] Assignee: The Procter & Gamble Co., Cincinnati, Ohio

[21] Appl. No.: 373,198

[22] PCT Filed: Jun. 30, 1993

[86] PCT No.: PCT/US93/06149

§ 371 Date: Jan. 17, 1995

§ 102(e) Date: Jan. 17, 1995

[87] PCT Pub. No.: WO94/02577

PCT Pub. Date: Feb. 3, 1994

[30] Foreign Application Priority Data

| | | | |
|---|---|---|---|
| Jul. 15, 1992 | [EP] | European Pat. Off. | 92202168 |
| Apr. 26, 1993 | [EP] | European Pat. Off. | 93201198 |
| Jun. 9, 1993 | [EP] | European Pat. Off. | 93870107 |

[51] Int. Cl.[6] ..... C11D 3/37

[52] U.S. Cl. ..... 252/542; 252/547; 252/174.12; 252/174.24; 252/DIG. 2; 525/326.7

[58] Field of Search ..... 252/542, 547, 252/174.12, 174.24, DIG. 2; 525/326.7

[56] References Cited

U.S. PATENT DOCUMENTS

| | | | |
|---|---|---|---|
| 3,159,611 | 12/1964 | Dunn et al. | 260/88.3 |
| 4,234,377 | 11/1980 | Pezzoli | 162/3 |
| 4,548,744 | 10/1985 | Connor | 252/545 |
| 4,698,171 | 10/1987 | Bertini et al. | 252/60 |
| 5,009,980 | 4/1991 | El-Sayed et al. | 430/114 |
| 5,298,289 | 3/1994 | Lindert et al. | 427/388.4 |

FOREIGN PATENT DOCUMENTS 1097450 1/1968 United Kingdom .

OTHER PUBLICATIONS

Klockars, Arch. Environ. Health, Effect of two particle surface modifying agents, 1990 vol. 45(1), pp. 8–14.

*Primary Examiner*—Paul Lieberman
*Assistant Examiner*—Michael Tierney
*Attorney, Agent, or Firm*—Michael D. Jones; Jerry J. Yetter; Jacobus C. Rasser

[57] ABSTRACT

The present invention relates to inhibiting dye transfer compositions comprising polyamine N-oxide polymers which contain units having the following structure formula:

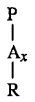

wherein

P is a polymerizable unit, whereto the N—group can be attached to or wherein the N—O group forms part of the polymerizable unit or a combination of both.

O O O

A is NC, CO, C, —O—, —S—, —N—; x is or 0 or 1;

R are aliphatic, ethoxylated aliphatics, aromatic, heterocyclic or alicyclic groups or any combination thereof whereto the nitrogen of the N—O group can be attached or wherein the nitrogen of the N—O group form part of these groups.

8 Claims, No Drawings

ENZYMATIC DETERGENT COMPOSITIONS INHIBITING DYE TRANSFER

FIELD OF THE INVENTION

The present invention relates to dye transfer inhibiting compositions containing enzymes. More in particular, this invention relates to dye transfer inhibiting compositions comprising polyamine N-oxide containing polymers and enzymes.

BACKGROUND OF THE INVENTION

Detergent compositions containing enzymes are well known in art. It is equally well recognized that enzyme deactivation occurs in detergent compositions formulated with enzymes. The loss of detergent activity of enzymes is among others depending on the presence of adjunct detergent ingredients.

One type of adjunct detergent ingredient that is added to detergent ingredients are dye transfer inhibiting polymers. Said polymers are added to detergent compositions in order to inhibit the transfer of dyes from colored fabrics onto other fabrics washed therewith. These polymers have the ability to complex or adsorb the fugitive dyes washed out of dyed fabrics before the dyes have the opportunity to become attached to other articles in the wash.

Copending European Patent Application No. 92202168.8 describes polyamine N-oxide containing polymers which are very efficient in eliminating transfer of solubilized or suspended dyes. It has now been surprisingly found that certain polyamine N-oxide polymers provide a stabilizing effect for enzymes formulated in detergent compositions.

In addition to this stabilizing effect, the dye transfer inhibiting performance of the polyamine N-oxide containing polymers are enhanced by the addition of certain type of enzymes. This finding allows to formulate detergent compositions which exhibit excellent dye transfer inhibiting properties while maintaining excellent enzyme activity.

According to another embodiment of this invention a process is also provided for laundering operations involving colored fabrics.

Polymers have been used within detergent compositions to inhibit dye transfer. EP-A-O 102 923 describes the use of carboxyl containing polymers within an aqueous compositions. DE-A-2 814 329 discloses the use of N-vinyl-oxazolidone polymers and FR-A-2 144 721 discloses the use of 15–35% of a copolymer of polyvinylpyrrolidone and acrylic acid nitrile or maleic anhydride within a washing powder. EP-265 257 describes detergent compositions comprising an alkali-metal carboxy-metal carboxymethylcellulose, a vinylpyrrolidone polymer and a polycarboxylate polymer.

SUMMARY OF THE INVENTION

The present invention relates to inhibiting dye transfer compositions comprising a) a polymer selected from polyamine N-oxide containing polymers which contain units having the following structure formula:

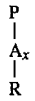

wherein

P is a polymerisable unit, whereto the N—O group can be attached to or wherein the N—O group forms part of the polymerisable unit.

A is NC(=O), CO(=O), C(=O), —O—, —S—, —N(—)—; x is 0 or 1;

R are aliphatic, ethoxylated aliphatic, aromatic, heterocyclic or alicyclic groups whereto the nitrogen of the N—O group can be attached or wherein the nitrogen of the N—O group is part of these groups.

b) an enzyme.

DETAILED DESCRIPTION OF THE INVENTION

The compositions of the present invention comprise as an essential element a polymer selected from polyamine N-oxide containing polymers which contain units having the following structure formula (I):

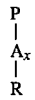

(I)

wherein

P is a polymerisable unit, whereto the R—N—O group can be attached to or wherein the R—N—O group forms part of the polymerisable unit or a combination of both.

A is NC(=O), CO(=O), C(=O), —O—, —S—, —N(—)—; x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups The N—O group can be represented by the following general structures:

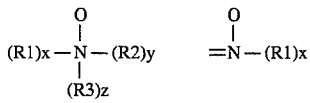

wherein

R1, R2, R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyridine, pyrrole, imidazole, pyrrolidine, piperidine, quinoline and derivatives thereof. Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine N-oxide containing polymer can be varied by appropriate co-polymerization or by appropriate degree of N-oxidation. Preferably, the ratio of amine to amine N-oxide is from 2:3 to 1:1000000. More preferably from 1:4 to 1:1000000, most preferably from 1:9 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine N-oxide containing polymers can be obtained in almost any degree of polymerisation. The degree of polymerisation is not critical provided the material has the desired water-solubility and dye-suspending power. Typically, the average molecular weight of the polyamine N-oxide containing polymers is within the range of 500 to 1000,000; preferably from 1000 to 30000, more preferably from 3000 to 20000, most preferably from 5000 to 15000.

The polyamine N-oxide containing polymers of the present invention are typically present from 0.001% to 10%, more preferably from 0.05% to 1%, most preferred from 0.05% to 0.5% by weight of the dye transfer inhibiting composition. The present compositions are conveniently used as additives to conventional detergent compositions for use in laundry operations. The present invention also encompasses dye transfer inhibiting compositions which will contain detergent ingredients and thus serve as detergent compositions.

Methods for making polyamine N-oxides:

The production of the polyamine-N-oxide containing polymers may be accomplished by polymerizing the amine monomer and oxidizing the resultant polymer with a suitable oxidizing agent, or the amine oxide monomer may itself be polymerized to obtain the polyamine N-oxide.

The synthesis of polyamine N-oxide containing polymers can be exemplified by the synthesis of polyvinyl-pyridine N-oxide. Poly-4-vinylpyridine ex Polysciences (mw. 50 000, 5.0 g., 0.0475 mole) was predisolved in 50 ml acetic acid and treated with a peracetic acid solution (25 g of glacial acetic acid, 6.4 g of a 30% vol. solution of $H_2O_2$, and a few drops of $H_2SO_4$give 0.0523 mols of peracetic acid) via a pipette. The mixture was stirred over 30 minutes at ambient temperature (32 C.). The mixture was then heated to 80–85 C. using an oil bath for 3 hours before allowing to stand overnight. The polymer solution then obtained is mixed with 11 of acetone under agitation. The resulting yellow brown viscous syrup formed on the bottom is washed again with 11 of aceton to yield a pale crystalline solid.

The solid was filtered off by gravity, washed with aceton and then dried over $P_2O_5$.

The amine : Amine N-oxide ratio of this polymer is 1:4 (determined by NMR).

ENZYMES

The enzymes which are to be included in the detergent formulations are detersive enzymes which can be used for a wide variety of purposes including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. Other types of enzymes may also be included. The enzymes may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.05 mg to about 3 mg, of active enzyme per gram of the composition.

Cellulase:

The cellulases usable in the present invention include both bacterial or fungal cellulase. Preferably, they will have a pH optimum of between 5 and 9.5. Suitable cellulases are disclosed in U.S. Pat. No. 4,435,307, which discloses fungal cellulase produced from *Humicola insolens*. Suitable cellulases are also disclosed in GB-A-2.075.028 ; GB-A-2.095.275 and DE-OS-2.247.832.

Examples of such cellulases are cellulases produced by a strain of *Humicola insolens* (*Humicola grisea* var. *thermoidea*), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (*Dolabella Auricula Solander*). Other suitable cellulases are cellulases originated from *Humicola Insulens* having a molecular weight of about 50 KDa, an isoelectric point of 5.5 and containing 415 amino acids. Such cellulase are described in Copending European patent application No. 93200811.3 Especially suitable cellulase are the cellulase having color care benefits. Examples of such cellulases are cellulase described in European patent application No. 91202879.2, Carenzyme (Novo). It has been found that cellulase enhances considerably the efficiency of polyamine N-oxide containing polymers in terms of color appearance.

Protease:

Suitable examples of proteases are the subtilisins which are obtained from particular strains of *B. subtilis* and *B. licheniforms*. Proteolytic enzymes suitable for removing protein-based stains that are commercially available include those sold under the tradenames Alcalase , Savinase and Esperase by Novo Industries A/S (Denmark) and Maxatase by International Bio-Synthetics, Inc. (The Netherlands) and FN-base by Genencor, Optimase and opticlean by MKC.

Of interest in the category of proteolytic enzymes, especially for liquid detergent compositions, are enzymes referred to herein as Protease A and Protease B. Protease A and methods for its preparation are described in European Patent Application 130,756. Protease B is a proteolytic enzyme which differs from Protease A in that it has a leucine substituted for tyrosine in position 217 in its amino acid sequence. Protease B is described in European Patent Application Serial No. 87303761.8. Methods for preparation of Protease B are also disclosed in European Pat. Application 130,756.

Amylase

Amylases include, for example, amylases obtained from a special strain of *B. licheniforms*, described in more detail in British Patent Specification No. 1,296,839 (Novo). Amylolytic proteins include, for example, Rapidase, Maxamyl (International Bio-Synthetics, Inc.) and Termamyl,(Novo Industries).

Lipase:

Suitable lipase enzymes for detergent usage include those produced by microorganisms of the Pseudomonas group, such as *Pseudomonas stutzeri* ATCC 19.154, as disclosed in British Patent No. 1,372,034. Suitable lipases include those which show a positive immunoligical cross-reaction with the antibody of the lipase, produced by the microorganism Pseudomonas fluorescent IAM 1057. This lipase and a method for its purification have been described in Japanese Patent Application 53-20487. This lipase is available from Amano Pharmaceutical Co. Ltd., Nagoya, Japan, under the trade name Lipase P "Amano," hereinafter referred to as "Amano-P". Such lipases of the present invention should show a positive immunological cross reaction with the Amano-P antibody, using the standard and well-known immunodiffusion procedure according to Ouchterlony (Acta. Med. Scan., 133, pages 76–79 (1950)). These lipases, and a method for their immunological cross-reaction with Amano-P, are also described in U.S. Pat. No. 4,707,291. Typical examples thereof are the Amano-P lipase, the lipase ex *Pseudomonas fragi* FERM P 1339 (available under the trade name Amano-B), lipase ex *Pseudomonas nitro-reducens* var. *lipolyticum* FERM P 1338 (available under the trade name Amano-CES), lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*. Especially suitable Lipase are lipase such as M1 Lipase (Ibis) and Lipolase (Novo).

Peroxidase:

Peroxidase enzymes are used in combination with oxygen sources, e.g. percarbonate, perborate, persulfate, hydrogen peroxide, etc They are used for "solution bleaching", i.e. to prevent transfer of dyes of pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT Internation Application WO 89/099813, published October 19, 1989, by O. Kirk, assigned to Novo Industries A/S, and in European Patent aplication No. 91202882.6.

The peroxidases which may be employed for the present purpose may be isolated from and are producible by plants (e.g. horseradish peroxidase) or micororganisms such as fungi or bacteria. Some preferred fungi include strains belonging to the subdivision Deuteromycotina, class Hyphomycetes, e.g. Fusarium, Humicola, Tricoderma, Myrothecium, Verticillum, Arthromyces, Caldariomyces, Ulocladium, Embellisia, Cladosporium or Dreschlera, in particular *Fusarium oxysporum* (DSM 2672), *Humicola insolens, Tricho-derma resii, Myrothecium verrucana* (IFO 6113), *Verticilluum alboatrum, Verticillum dahlie, Arthromyces ramosus* (FERM P-7754), *Caldariomyces fumago, Ulocladium chartarum, Embellisia allior Dreschlera halodes.*

Other preferred fungi include strains belonging to the subdivision Basidiomycotina, class Basidiomycetes, e.g. Coprinus, Phanerochaete, Coriolus or Trametes, in particular *Coprinus cinereus* f. *microsporus* (IFO 8371), *Coprinus macrorhizus, Phanerochaete chrysosporium* (e.g. NA-12) or *Coriolus versicolor* (e.g. PR4 28-A).

Further preferred fungi include strains belonging to the subdivision Zygomycotina, class Mycoraceae, e.g. Rhizopus or Mucor, in particular *Mucor hiemalis.*

Some preferred bacteria include strains of the order Actinomycetales, e.g. Streptomyces spheroides (ATTC 23965), *Streptomyces thermoviolaceus* (IFO 12382) or *Strep-toverticillum verticillium* ssp. *verticillium.*

Other preferred bacteria inlude *Bacillus pumillus* (ATCC 12905), *Bacillus stearothermophilus, Rhododbacter sphaeroides, Rhodomonas palustri, Streptococcus lactis, Pseudomonas purrocinia* (ATCC 15958) or *Pseudomonas fluorescens* (NRRL B-11).

Other potential sources of useful peroxidases are listed in B. C. Saunders et al., op. cit., pp. 41–43.

Methods of producing enzymes to be used according to the invention are described in the art, cf. for example *FEBS Letters* 1625, 173(1), *Applied and Environmental Microbiology*, Feb. 1985, pp. 273–278, *Applied Microbiol. Biotechnol.* 26, 1987, pp. 158–163, *Biotechnology Letters* 9(5), 1987, pp. 357–360, *Nature* 326, Apr. 2, 1987, *FEBS Letters* 4270, 209(2), p.321, EP 179 486, EP 200 565, GB 2 167 421, EP 171 074, and *Agric. Biol. Chem.* 50(1), 1986, p. 247.

Particularly preferred peroxidases are those which are active at the typical pH of washing liquors, i.e. at a pH of 6.5–10.5, preferably 6.5–9.5, and most preferably 7.5–9.5. Such enzymes may be isolated by screening for the relevant enzyme production by alkalophilic microorganisms, e.g. using the ABTS assay described in R. E. Childs and W. G. Bardsley, *Biochem. J.*145, 1975, pp. 93–103.

Other preferred peroxidases are those which exhibit a good thermostability as well as a good stability towards commonly used detergent components such as non-ionic, cat-ionic, or anionic surfactants, detergent builders, phosphate etc.

Another group of useful peroxidases are haloperoxidases, such as chloro- and bromoperoxidases.

The peroxidase-enzyme may futhermore be one which is producible by a method comprising cultivating a host cell transformed with a recombinant DNA vector which carries a DNA sequence encoding said enzyme as well as DNA sequences encoding functions permitting the expression of the DNA sequence encoding the enzyme, in a culture medium under conditions permitting the expression of the enzyme and recovering the enzyme from the culture.

A DNA fragment encoding the enzyme may, for instance, be isolated by establishing a cDNA or genomic library of a microorganism producing the enzyme of interest, such as one of the organisms mentioned above, and screening for positive clones by conventional procedures such as by hybridization to oligonucleotide probes synthesized on the basis of the full or partial amino acid sequence of the enzyme, or by selecting for clones expressing the appropriate enzyme activity , or by selecting for clones producing a protein which is reactive with an antibody against the native enzyme.

Once selected, the DNA sequence may be inserted into a suitable replicable expression vector comprising appropriate promotor, operator and terminator sequences permitting the enzyme to be expressed in a particular host organism, as well as an origin of replication, enabling the vector to replicate in the host organism in question.

The resulting expression vector may then be transformed into a suitable host cell, such as a fungal cell, preferred examples of which are a species of Aspergillus, most preferably *Aspergillus oryzae* or *Aspergillus niger*. Fungal cells may be transformed by a process involving protoplast formation and transformation of the protoplasts followed by regeneration of the cell wall in a manner known per se. The use of Aspergillus as a host micororganism is described in EP 238,023 (of Novo Industri A/S).

Alternatively, the host organisms may be a bacterium, in particular strains of Streptomyces and Bacillus, or *E. coli*. The transformation of bacterial cells may be performed according to conventional methods, e.g. as described in T. Maniatis et al., *Molecular Cloning: A Laboratory Manual*, Cold Spring Harbor, 1982.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

The screening of appropriate DNA sequences and construction of vectors may also be carried out by standard procedures, cf. T. Maniatis et al., op. cit.

The medium used to cultivate the transformed host cells may be any conventional medium suitable for growing the host cells in question. The expressed enzyme may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

At the beginning or during the process, $H_2O_2$ may be added, e.g. in an amount of 0.001–5 mM, particularly 0.01–1 mM. When using Coprinus peroxidase, 0.01–0.25 mM $H_2O_2$ is preferred, and with *B. pumilus* peroxidase 0.1–1 mM $H_2O_2$.

The hydrogen peroxide may be added as hydrogen peroxide or a precursor thereof, preferably a perborate or percarbonate. The level of hydrogen peroxide precursor that can be used is dependent on the specific properties of the peroxidase chosen, e.g. Coprinus peroxidase should be applied in a detergent composition which contains less than 5% perborate.

In the process of this invention, it may be desirable to utilize an enzymatic process for hydrogen peroxide formation. Thus, the process according to the invention may additionally comprise adding an enzymatic system (i.e. an enzyme and a substrate therefore) which is capable of generating hydrogen peroxide at the beginning or during the washing and/or rinsing process.

One such category of hydrogen peroxide generating systems comprises enzymes which are able to convert molecular oxygen and an organic or inorganic substrate into hydrogen peroxide and the oxidized substrate respectively. These enzymes produce only low levels of hydrogen peroxide, but they may be employed to great advantage in the process of the invention as the presence of peroxidase ensures an efficient utilization of the hydrogen peroxide produced.

Preferred hydrogen peroxide-generating enzymes are those which act on cheap and readily available substrates which may conveniently be included into detergent compositions. An example of such a substrate is glucose which may be utilized for hydrogen peroxide production by means of glucose oxidase. Suitable oxidases include those which act on aromatic compounds such as phenols and related substances, e.g. catechol oxidases, laccase. Other suitable oxidases are urate oxidase, galactose oxidase, alcohol oxidases, amine oxidases, amino acid oxidase, amyloglucosidase, and cholesterol oxidase.

The preferred enzymatic systems are alcohol and aldehyde oxidases.

The more preferred systems for granular detergent application would have solid alcohols, e.g. glucose whose oxidation is catalysed by glucose oxidase to glucoronic acid with the formation of hydrogen peroxide.

The more preferred systems for liquid detergent application would involve liquid alcohols which could also act as, for example, solvents. An example is ethanol/ethanol oxidase.

The quantity of oxidase to be employed in compositions according to the invention should be at least sufficient to provide a constant generation of 0.01 to 10 ppm AvO per minute in the wash. For example, with the glucose oxidase, this can be achieved at room temperature and at pH 6 to 11, preferentially 7 to 9 with 50–5000 U/1 glucose oxidase, 0.005 to 0.5% glucose under constant aeration.

The addition of another oxidisable substrate for the peroxidase at the beginning or during the washing and/or rinsing process may enhance the dye transfer inhibitory effect of the peroxidase employed. This is thought to be ascribable to the formation of short-lived radicals or other oxidised states of this substrate which participate in the bleaching or other modification of the coloured substance. Examples of such oxidisable substrates are metal ions, e.g. $Mn^{++}$, halide ions, e.g. chloride or bromide ions, or organic compounds such as phenols, e.g. p-hydroxycinnamic acid or 2,4-dichlorophenol. Other examples of phenolic compounds which may be used for the present purpose are those given in M. Kato and S. Shimizu, *Plant Cell Physiol.* 26(7), 1985, pp. 1291–1301 (cf. Table 1 in particular) or B.C. Saunders et al., op. cit., p. 141 ff. The amount of oxidisable substrate to be added is suitably between about 1 μM and 1 mM.

In the process of the invention, the peroxidase will typically be added as a component of a detergent composition and may be added in an amount of 0.01–100 mg enzyme per liter of wash liquid. As such, it may be included in the detergent composition in the form of a non-dusting granulate, a liquid, in particular a stabilized liquid, or a protected enzyme. Non-dusting granulates may be produced, e.g. as disclosed in U.S. Pat. Nos. 4,106,991 and 4,661,452 (both to Novo Industri A/S) and may optionally be coated by methods known in the art. Liquid enzyme preparations may, for instance, be stabilized by adding a polyol such as propylene glycol, a sugar or sugar alcohol, lactic acid or boric acid according to established methods. Other enzyme stabilizers are well known in the art. Protected enzymes may be prepared according to the method disclosed in EP 238,216. The detergent composition may also comprise one or more substrates for the peroxidase. Usually, the pH of a solution of the detergent composition of the invention will be preferably from 7–12, especially from 7.5 to 9.5. The wash pH is dependent on the peroxidase chosen, e.g. Coprinus peroxidase should be applied in a wash pH below 9.5. It has been found that peroxidases enhance considerably the efficiency of polyamine N-oxide containing polymers in terms of dye transfer inhibition.

A wide range of enzyme materials and means for their incorporation into synthetic detergent granules is also disclosed in U.S. Pat. No. 3,553,139. Enzymes are further disclosed in U.S. Pat. No. 4,101,457, Place et al, issued Jul. 18, 1978, and in U.S. Pat. No. 4,507,219, Hughes, issued Mar. 26, 1985, both incorporated herein by reference. Enzyme materials useful for liquid detergent formulations, and their incorporation into such formulations, are disclosed in U.S. Pat. No. 4,261,868, Hora et al, issued Apr. 14, 1981.

For granular detergents, the enzymes are preferably coated or prilled with additives inert toward the enzymes to minimize dust formation and improve storage stability. Techniques for accomplishing this are well-known in the art. In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate and calcium propionate. Calcium ions can be used in combination with short chain carboxylic acid salts, preferably formates. See, for example, U.S. Pat. No. 4,318,818. It has also been proposed to use polyols like glycerol and sorbitol. Alkoxyalcohols, dialkylglycoethers, mixtures of polyvalent alcohols with polyfunctional aliphatic amines (e.g., such as diethanolamine, triethanolamine, di-isopropanolamime, etc.), and boric acid or alkali metal borate. Enzyme stabilization techniques are additionally disclosed and exemplified in U.S. Pat. Nos. 4,261,868, 3,600,319 and European Patent Application Publication No. 0 199 405, Application No. 86200586.5, Venegas. Non-boric acid and borate stabilizers are preferred. Enzyme stabilization systems are also described, for example, in U.S. Pat. Nos. 4,261,868, 3,600,319 and 3,519,570.

DETERGENT ADJUNCTS

A wide range of surfactants can be used in the detergent compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO\,(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula $$R^2-\underset{\underset{O}{\|}}{C}-\underset{\underset{R^1}{|}}{N}-Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein. Suitable builders can be an inorganic ion exchange material, commonly an inorganic hydrated aluminosilicate material, more particularly a hydrated synthetic zeolite such as hydrated zeolite A, X, B or HS. Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycollic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,082,179, while polycarboxylates containing phosphone substituents are disclosed in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6 -hexane-hexacarboxylates and and carboxymethyl derivatives of polyhydric alcohols such as sorbitol, mannitol and xylitol. Aromatic polycarboxylates include mellitic acid, pyromellitic acid and the phtalic acid derivatives disclosed in British Patent No. 1,425,343.

Of the above, the preferred polycarboxylates are hydroxycarboxylates containing up to three carboxy groups per molecule, more particularly citrates. Preferred builder systems for use in the present compositions include a mixture of a water-insoluble aluminosilicate builder such as zeolite A or of a layered silicate (sks/6), and a water-soluble carboxylate chelating agent such as citric acid.

A suitable chelant for inclusion in the detergent compositions in accordance with the invention is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and $Na_4$EDDS. Examples of such preferred magnesium salts of EDDS include MgEDDS and $Mg_2$EDDS. The magnesium salts are the most preferred for inclusion in compositions in accordance with the invention.

Especially for the liquid execution herein, suitable fatty acid builders for use herein are saturated or unsaturated C10–18 fatty acids, as well as well as the corresponding soaps. Preferred saturated species have from 12 to 16 carbon atoms in the alkyl chain. The preferred unsaturated fatty acid is oleic acid.

Preferred builder systems for use in granular compositions include a mixture of a water-insoluble aluminosilicate builder such as zeolite A, and a watersoluble carboxylate chelating agent such as citric acid.

Other builder materials that can form part of the builder system for use in granular compositions the purposes of the invention include inorganic materials such as alkali metal carbonates, bicarbonates, silicates, and organic materials such as the organic phosphonates, amiono polyalkylene phosphonates and amino polycarboxylates.

Other suitable water-soluble organic salts are the homo- or copolymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Detergent ingredients that can be included in the detergent compositions of the present invention include bleaching agents. These bleaching agent components can include one or more oxygen bleaching agents and, depending upon the bleaching agent chosen, one or more bleach activators. When present bleaching compounds will typically be present at levels of from about 1% to about 10%, of the detergent composition. In general, bleaching compounds are optional components in non-liquid formulations, e.g. granular detergents. If present, the amount of bleach activators will typically be from about 0.1% to about 60%, more typically from about 0.5% to about 40% of the bleaching composition.

The bleaching agent component for use herein can be any of the bleaching agents useful for detergent compositions including oxygen bleaches as well as others known in the art.

In a method aspect, this invention further provides a method for cleaning fabrics, fibers, textiles, at temperatures below about 50° C., especially below about 40° C., with a detergent composition containing polyamine N-oxide containing polymers, optional auxiliary detersive surfactants, optional detersive adjunct ingredients, and a bleaching agent.

The bleaching agent suitable for the present invention can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, U.S. patent application Ser. No. 740,446, European Patent Application 0,133,354 and U.S. Pat. No. 4,412,934. Highly preferred bleaching agents also include 6-nonylamino- 6-oxoperoxycaproic acid as described in U.S. Pat. No. 4,634,551.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5–10% by weight of the finished product, preferably 1–5% by weight.

Preferably, the bleaches suitable for the present invention include peroxygen bleaches. Examples of suitable water-soluble solid peroxygen bleaches include hydrogen peroxide releasing agents such as hydrogen peroxide, perborates, e.g. perborate monohydrate, perborate tetrahydrate, persulfates, percarbonates, peroxydisulfates, perphosphates and peroxyhydrates. Preferred bleaches are percarbonates and perborates.

The hydrogen peroxide releasing agents can be used in combination with bleach activators such as tetraacetylethylenediamine (TAED), nonanoyloxybenzenesulfonate (NOBS, described in U.S. Pat. No. 4,412,934), 3,5,-trimethylhexanoloxybenzenesulfonate (ISONOBS, described in EP 120,591) or pentaacetylglucose (PAG), which are perhydrolyzed to form a peracid as the active bleaching species, leading to improved bleaching effect. Also suitable activators are acylated citrate esters such as disclosed in Copending European Patent Application No. 91870207.7.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other peroxygen bleaches suitable for the present invention include organic peroxyacids such as percarboxylic acids.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718. Typically, detergent compositions will contain about 0.025% to about 1.25%, by weight, of sulfonated zinc phthalocyanine.

Other suitable detergent ingredients that can be added are enzyme oxidation scavengers which are described in Copending European Patent aplication N 92870018.6 filed on Jan. 31, 1992. Examples of such enzyme oxidation scavengers are ethoxylated tetraethylene polyamines. Especially preferred detergent ingredients that can be added are technologies which also provide a type of color care benefit. Examples of these technologies are metallo catalysts for color maintance rejuvenation. Such metallo catalysts are described in copending European Patent Application No. 92870181.2.

In addition, it has been found that the polyamine-N-oxide containing polymers eliminate or reduce the deposition of the metallo-catalyst onto the fabrics resulting in improved whiteness benefit.

Another optional ingredient is a suds suppressor, exemplified by silicones, and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent impermeable carrier. Alternatively the suds suppressor can be dissolved or dispersed in a liquid carrier and applied by spraying on to one or more of the other components.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2 646 126 published Apr. 28, 1977. An example of such a compound is DC-544, commercially available from Dow Corning, which is a siloxane-glycol copolymer. Especially preferred suds controlling agent are the suds suppressor system comprising a mixture of silicone oils and 2-alkyl-alcanols. Suitable 2-alkyl-alcanols are 2-butyl-octanol which are commercially available under the trade name Isofol 12 R.

Such suds suppressor system are described in Copending European Patent application N 92870174.7 filed 10 Nov. 1992.

Especially preferred silicone suds controlling agents are described in Copending European Patent application No. 92201649.8 Said compositions can comprise a silicone/silica mixture in combination with fumed nonporous silica such as Aerosil$^R$.

The suds suppressors described above are normally employed at levels of from 0.001% to 2% by weight of the composition, preferably from 0.01% to 1% by weight.

Other components used in detergent compositions may be employed, such as soil-suspending agents soil-release agents, optical brighteners, abrasives, bactericides, tarnish inhibitors, coloring agents and encapsulated and/or non-encapsulated perfumes.

Antiredeposition and soil suspension agents suitable herein include cellulose derivatives such as methylcellulose, carboxymethylcellulose and hydroxyethylcellulose, and homo- or co-polymeric polycarboxylic acids or their salts. Polymers of this type include the polyacrylates and maleic anhydride-acrylic acid copolymers previously mentioned as builders, as well as copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Preferred optical brighteners are anionic in character, examples of which are disodium 4,4$^1$-bis-(2-diethanolamino-4 -anilino-s-triazin-6-ylamino)stilbene-2:2$^1$ disulphonate, disodium 4,-4$^1$-bis-(2-morpholino-4-anilino-s-triazin-6-ylamminostilbene-2:2$^1$-disulphonate, disodium 4,4$^1$-bis-(2,4 -dianilino-s-triazin-6-ylamino)stilbene-2:2$^1$-disulphonate, monosodium 4$^1$,4$^{11}$-bis-(2,4-dianilino-s-triazin-6ylamino)stilbene-2-sulphonate, disodium 4,4$^1$-bis-(2-anilino-4-(N-methyl-N-2-hydroxyethylamino)-s-triazin-6-ylamino)stilbene-2,2$^1$-disulphonate, disodium 4,4$^1$-bis-(4-phenyl-2,1,3-triazol-2-yl)-stilbene-2,2$^1$disulphonate, disodium 4,4$^1$bis(2-anilino-4--(1-methyl-2-hydroxyethylamino)-s-triazin-6-ylamino) stilbene-2,2$^1$disulphonate and sodium 2(stilbyl-4$^{11}$-(naphtho-1$^1$,2$^1$:4,5)-1,2,3-triazole-2$^{11}$-sulphonate.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $$(CH_3(PEG)_{43})_{0.75}(POH)_{0.25}[T-PO)_{2.8}(T-PEG)_{0.4}]T(PO-H)_{0.25}((PEG)_{43}CH_3)_{0.75}$$

where PEG is $-(OC_2H_4)O-$,PO is $(OC_3H_6O)$ and T is $(pcOC_6H_4CO)$.

Also very useful are modified polyesters as random copolymers of dimethyl terephtalate, dimethyl sulfoisophtalate, ethylene glycol and 1–2 propane diol, the end groups consisting primarily of sulphobenzoate and secondarily of mono esters of ethylene glycol and/or propane-diol. The target is to obtain a polymer capped at both end by sulphobenzoate groups, "primarily", in the present context most of said copolymers herein will be end-capped by sulphobenzoate groups. However, some copolymers will be less than fully capped, and therefore their end groups may consist of monoester of ethylene glycol and/or propane 1–2 diol, thereof consist "secondarily" of such species.

The selected polyesters herein contain about 46% by weight of dimethyl terephtalic acid, about 16% by weight of propane -1.2 diol, about 10% by weight ethylene glycol about 13% by weight of dimethyl sulfobenzoid acid and about 15% by weight of sulfoisophtalic acid, and have a molecular weight of about 3,000. The polyesters and their method of preparation are described in detail in EPA 311 342.

The detergent compositions according to the invention can be in liquid, paste, gels or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid compositions according to the present invention can also be in "concentrated form", in such case, the liquid detergent compositions according to the present invention will contain a lower amount of water, compared to conventional liquid detergents. Typically, the water content of the concentrated liquid detergent is less than 30%, more preferably less than 20%, most preferably less than 10% by weight of the detergent compositions. Other examples of liquid compositions are anhydrous compositions containing substantially no water. Both aqueous and non-aqueous liquid compositions can be structured or non-structured.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. and higher temperatures. The pH of the treatment solution is preferably from 7 to 11, especially from 7.5 to 10.5.

The process and compositions of the invention can also be used as detergent additive products. Such additive products are intended to supplement or boost the performance of conventional detergent compositions.

The detergent compositions according to the present invention include compositions which are to be used for cleaning substrates, such as fabrics, fibers, hard surfaces, skin etc., for example hard surface cleaning compositions (with or without abrasives), laundry detergent compositions, automatic and non automatic dishwashing compositions.

The following examples are meant to exemplify compositions of the present invention, but are not necessarily meant to limit or otherwise define the scope of the invention, said scope being determined according to claims which follow.

A liquid detergent composition according to the present invention is prepared, having the following compositions:

TABLE I

| % by weight of the total detergent composition | |
|---|---|
| Linear alkylbenzene sulfonate | 10 |
| Alkyl sulphate | 4 |
| Fatty alcohol ($C_{12}$–$C_{15}$) ethoxylate | 12 |
| Fatty acid | 10 |
| Oleic acid | 4 |
| Citric acid | 1 |
| NaOH | 3.4 |
| Propanediol | 1.5 |
| Ethanol | 10 |

EXAMPLE I

The extent of dye transfer from different colored fabrics was studied using a launder-o-meter test that simulates a 30 min wash cycle. The launder-o-meter beaker contains 200 ml of a detergent solution, a 10 cm×10 cm piece of the colored fabric and a multifiber swatch which is used as a pick-up tracer for the bleeding dye. The multifiber swatch consists of 6 pieces (1.5 cm×5 cm each) of different material (polyacetate, cotton, polyamide, polyester, wool and orlon) which are sewn together.

The extent of dye transfer is assessed by a Hunter Colour measurement. The Hunter Colour system evaluates the colour of a fabric sample in terms of the ΔE value which represents the change in the Hunter L, a, b,values which are determined by reflecting spectrometrie. The ΔE value is defined by the following equation:

$$\Delta E=\{(a_f-a_i)^2+(b_f-b_i)^2+(L_f-L_i)^2\}^{1/2}$$

where the subscripts i and f refer to the Hunter value before and after washing in the presence of the bleeding fabric, respectively. The least significant difference is 1 at 95% confidence level.

Experimental conditions:

Example I demonstrates the increased dye transfer inhibiting performance of the combination of polyamine-N-oxide containing polymers (PVNO : poly(4-vinylpyridine-N-oxide) which has an average molecular weight of about 10,000 and an amine to amine N-oxide ratio of 1:10 (determined by NMR)) and peroxidase.

The extent of dye transfer from different colored fabrics was studied using a launder-o-meter test that simulates a 30 min wash cycle. The launder-o-meter beaker contains 0.7% of the detergent composition, a 10 cm×10 cm piece of the colored fabric and a multifiber swatch which is used as a pick-up tracer for the bleeding dye. The multifiber swatch consists each of cotton.

A set of two realistic bleeding fabrics (50 $cm^2$ of each) were washed together with a multifiber pick-up tracer in a launderometer for 30 min. In a first launderometer pot (Test A), the detergent solution did not contain any dye transfer inhibiting agent. The second pot contained 10 ppm PVNO (Test B). The third pot contained 7 peroxidase (ex-Novo) Units/ml of wash solution (Test C). Also added are 10 ppm glucose and 0.1 units of Glox/ml to generate oxygen which is necessary to activate the Peroxidase. Finally the fourth pot contains the peroxidase system and PVNO (Test D).

TABLE

Level of dye transfer reduction by PVNO, Peroxidase and the combination (ΔE values).
pH = 7.8/Washing temperature 40° C.

| Bleeding fabric composition | Bleeding fabric color | A | B | C | D |
|---|---|---|---|---|---|
| 100% cotton | Direct blue 90 | 21.0 | 14.8 | 12.1 | 2.7 |

EXAMPLE II

A liquid detergent composition according to the present invention is prepared, having the following compositions:

| % by weight of the total detergent composition | A | B | C | D |
|---|---|---|---|---|
| Linear alkylbenzene sulfonate | 10 | 10 | 10 | 10 |
| Alkyl sulphate | 4 | 4 | 4 | 4 |
| Fatty alcohol ($C_{12}$–$C_{15}$) ethoxylate | 12 | 12 | 12 | 12 |
| Fatty acid | 10 | 10 | 10 | 10 |
| Oleic acid | 4 | 4 | 4 | 4 |
| Citric acid | 1 | 1 | 1 | 1 |
| Diethylenetriaminepentamethylene Phosphonic acid | 1.5 | 1.5 | 1.5 | 1.5 |
| NaOH | 3.4 | 3.4 | 3.4 | 3.4 |
| Propanediol | 1.5 | 1.5 | 1.5 | 1.5 |
| Ethanol | 10 | 10 | 10 | 10 |
| Ethoxylated tetraethylene pentamine | 0.7 | 0.7 | 0.7 | 0.7 |
| Poly(4-vinylpyridine)-N-oxide | 0–1 | 0–1 | 0–1 | 0–1 |
| Thermamyl | 0.13 | — | 0.13 | 0.13 |
| Carezyme | 0.01 | 0.01 | — | 0.01 |
| FN-Base | 1.8 | 1.8 | 1.8 | — |
| Lipolase | 0.14 | 0.14 | 0.14 | 0.14 |
| Endoglucanase A | 0.53 | 0.53 | — | 0.53 |
| Suds supressor (ISOFOL') | 2.5 | 2.5 | 2.5 | 2.5 |
| Minors | up to 100 | | | |

EXAMPLE III

A compact granular detergent composition according to the present invention is prepared, having the following formulation:

| % by weight of the total detergent composition | A | B | C | D |
|---|---|---|---|---|
| Linear alkyl benzene sulphonate | 11.40 | 11.40 | 11.40 | 11.40 |
| Tallow alkyl sulphate | 1.80 | 1.80 | 1.80 | 1.80 |
| $C_{45}$ alkyl sulphate | 3.00 | 3.00 | 3.00 | 3.00 |
| $C_{45}$ alcohol 7 times ethoxylated | 4.00 | 4.00 | 4.00 | 4.00 |
| Tallow alcohol 11 times ethoxylated | 1.80 | 1.80 | 1.80 | 1.80 |
| Dispersant | 0.07 | 0.07 | 0.07 | 0.07 |
| Silicone fluid | 0.80 | 0.80 | 0.80 | 0.80 |
| Trisodium citrate | 14.00 | 14.00 | 14.00 | 14.00 |
| Citric acid | 3.00 | 3.00 | 3.00 | 3.00 |
| Zeolite | 32.50 | 32.50 | 32.50 | 32.50 |
| Maleic acid acrylic acid copolymer | 5.00 | 5.00 | 5.00 | 5.00 |
| Perborate | 0.5 | 0.5 | 0.5 | 0.5 |
| Cellulase (active protein) | 0.03 | 0.2 | — | 0.2 |
| Alkalase/BAN | 0.60 | — | 0.6 | 0.6 |
| Lipase | 0.36 | 0.36 | 0.36 | — |
| Peroxidase | 0.4 | — | 0.4 | 0.4 |
| Sodium silicate | 2.00 | 2.00 | 2.00 | 2.00 |
| Sodium sulphate | 3.50 | 3.50 | 3.50 | 3.50 |
| Poly(4-vinylpyridine)-N-oxide | 0–1 | 0–1 | 0–1 | 0–1 |
| Minors | up to 100 | | | |

The above compositions (Example II and III) were very good at displaying excellent cleaning and detergency performance with outstanding color-care performance on colored fabrics and mixed loads of colored and white fabrics.

We claim:

1. A dye transfer inhibiting detergent composition comprising a) poly(4-vinylpyridine-N-oxide) having a ratio of amine to amine N-oxide of from about 2:3 to about 1:1,000,000; and

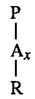

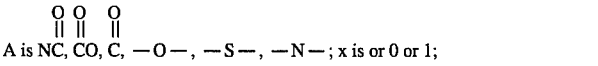

A is NC, CO, C, —O—, —S—, —N—; x is or 0 or 1;

b) a cleaning effective amount of an enzyme.

2. A dye transfer inhibiting composition according to claim 1 wherein the poly(4-vinylpyridine-N-oxide) polymer has an average molecular weight within the range of 500 to 1,000,000.

3. A dye transfer inhibiting composition according to claim 1 wherein the poly(4-vinylpyridine-N-oxide) is present at levels from 0.001 to 10% by weight of the composition.

4. A dye transfer inhibiting composition according to claim 1 wherein said enzyme is selected from the group consisting of cellulases, peroxidases, lipases, amylases, or mixtures thereof.

5. A dye transfer inhibiting compositions according to claim 1 wherein said enzyme is a cellulase or a peroxidase or a mixture thereof.

6. A detergent composition which comprises a dye transfer inhibiting composition according to claim 1 further comprising surfactants, builders chelants, bleaching agents, soil-suspending agents, suds suppressors soil release agents, optical brighteners, abrasives, bactericides, tarnish inhibitors, coloring agents, perfumes, or mixtures thereof.

7. A dye transfer inhibiting composition in the form of a non-dusting granule or a liquid detergent additive; said composition comprises:

a) poly(4-vinylpyridine-N-oxide) having a ratio of amine to amine N-oxide of from about 2:3 to about 1:1,000,000;and b) a cleaning effective amount of an enzyme.

8. A detergent composition which comprises a dye transfer inhibiting composition according to claim 7 further comprising surfactants, builders, chelants, bleaching agents, soil-suspending agents, suds suppressor, soil release agents, optical brighteners, abrasives, bactericides, tarnish inhibitors, coloring agents, perfumes, or mixtures thereof.

* * * * *